United States Patent [19]

Hansen

[11] Patent Number: 4,555,928

[45] Date of Patent: Dec. 3, 1985

[54] PRESS HAVING A LEVERAGED LINKAGE ASSEMBLY MECHANISM

[75] Inventor: David M. Hansen, Doylestown, Pa.

[73] Assignee: Penn Engineering & Manufacturing Corp., Danboro, Pa.

[21] Appl. No.: 489,032

[22] Filed: Apr. 27, 1983

[51] Int. Cl.[4] ..... B21J 9/18

[52] U.S. Cl. ..... 72/451; 83/554

[58] Field of Search ..... 72/451, 450, 453.01, 72/453.02, 453.03, 453.18, 435, 436, 437, 429; 83/554; 100/270, 271

[56] References Cited

U.S. PATENT DOCUMENTS 4,393,684 7/1983 Hansen et al. ..... 72/451

*Primary Examiner*—E. Michael Combs
*Assistant Examiner*—Linda McLaughlin
*Attorney, Agent, or Firm*—Gregory J. Gore

[57] ABSTRACT

A press for assembling a fastener or the like to a plate or the like comprises a frame and an anvil assembly carried by the frame. A linkage mechanism assembly is carried by the frame and includes two links. A ram assembly is operatively connectable to one of the two links. A first fluid operated cylinder and piston assembly holds the ram assembly in a raised position. A first switch terminates the flow of fluid to the first cylinder, thereby permitting the ram assembly to drop. A second fluid switch is activated after a sufficient drop of said piston to energize a second fluid operated cylinder and piston assembly for extending and retracting said links, and thereby move one of said links into force transmitting relationship with said ram assembly, to thereby cause said ram assembly to move forcefully down toward the fastener for the purpose of installing the fastener into the plate.

4 Claims, 13 Drawing Figures

PRESS HAVING A LEVERAGED LINKAGE ASSEMBLY MECHANISM

BACKGROUND OF THE INVENTION

This invention relates to presses of the type for installing fasteners or the like into sheeted plates. A press of this type is disclosed in U.S. Pat. No. 3,465,410 and U.S. patent application Ser. No. 233,942, filed Feb. 12, 1981.

SUMMARY OF THE INVENTION

It is an object of this invention to provide a press for installing fasteners or the like wherein the press is about the same size as that of a previously known press, i.e., the press disclosed in patent application Ser. No. 233,942 but which will be capable of applying a greatly increased force.

It is a further object of this invention to provide a press in which the high force applied to the ram assembly is available over a longer distance of travel of the ram assembly so that the press will be better adapted to installing, into a plate, items other than fasteners which items might require the application of the high force over a longer distance than is required for pressing fasteners into the plate.

A press for assembling a fastener or the like to a plate or the like comprises a frame and an anvil assembly carried by the frame. A linkage mechanism assembly is carried by the frame and includes two links, one of which is much longer relative to the other. A ram assembly is operatively connectable and disconnectable from the long link. A first fluid operated cylinder and piston assembly holds the ram assembly in a raised position. A first switch terminates the flow of fluid to the first cylinder, thereby permitting the ram assembly to drop. A second switch is activated after a sufficient drop of the ram assembly to energize a second fluid operated cylinder and piston assembly for thereafter pivoting the long link over the top of the ram assembly and continued pivoting of the long link causes the long link to move into force transmitting relationship with the ram assembly, to thereby cause the ram assembly to move forcefully down toward the fastener for the purpose of installing the fastener into the plate.

BRIEF DESCRIPTION OF THE VIEWS

DESCRIPTION OF THE PREFERRED EMBODIMENTS

Figure 1:
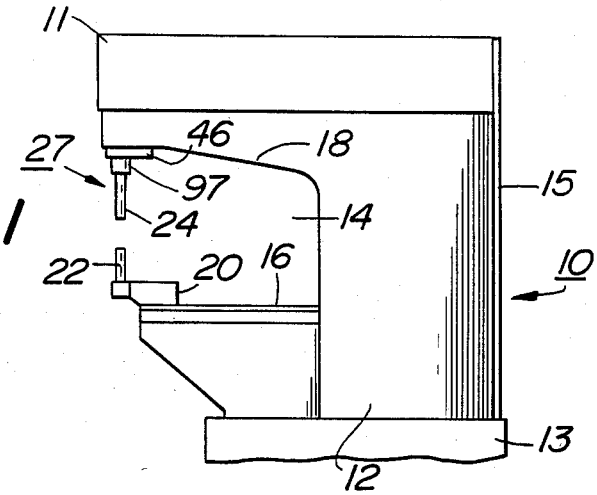
FIG. 1 is a side elevation of the press embodying this invention with the ram assembly shown fully raised or retracted.

Referring to the drawings, FIG. 1 is a side elevation view illustrating the press 10 of this invention. The press 10 comprises a frame 12 secured to a suitable base 13, FIG. 1. The upper part of the frame 12 may be provided with a suitable cover 11 and the rear thereof with a hinged door 15. The frame 12 defines a throat 14 between a jaw 16 and a roof 18, FIG. 2. Secured (by suitable bolts) to the jaw 16 is an anvil holder 20 supporting an anvil 22. Positioned vertically above the anvil 22 is a punch 24. The upper part of the punch 24 is inserted into and carried by a punch holder or bushing 25 which has its upper part, in turn, threaded into and carried by a ram 29. A socket screw 23 threaded into the holder 25 secures the punch 24 to the holder 25, FIG. 6. A hexagon jam nut 28 is threaded onto the upper part of the punch holder 25 and is seated against the lower surface of the ram 29, FIG. 6. The ram 29 includes a cap 35 of a hard material, such as hardened steel, resting upon and suitably secured to the upper end of the ram 29. The ram 29, the cap 35, the nut 28, the punch holder 25 and the punch 24 are hereafter referred to collectively as the ram assembly 27. The ram assembly 27 is raised and lowered as hereafter further described to press a fastener 31 (or the like) into a thin sheeted plate 33 or the like resting upon the anvil 22, the fastener 31 and plate 33 being illustrated in FIG. 3 only. It is understood that all or a portion of the fastener 31 may be pressed into the plate 33 to secure the former to the latter.

Figure 4:
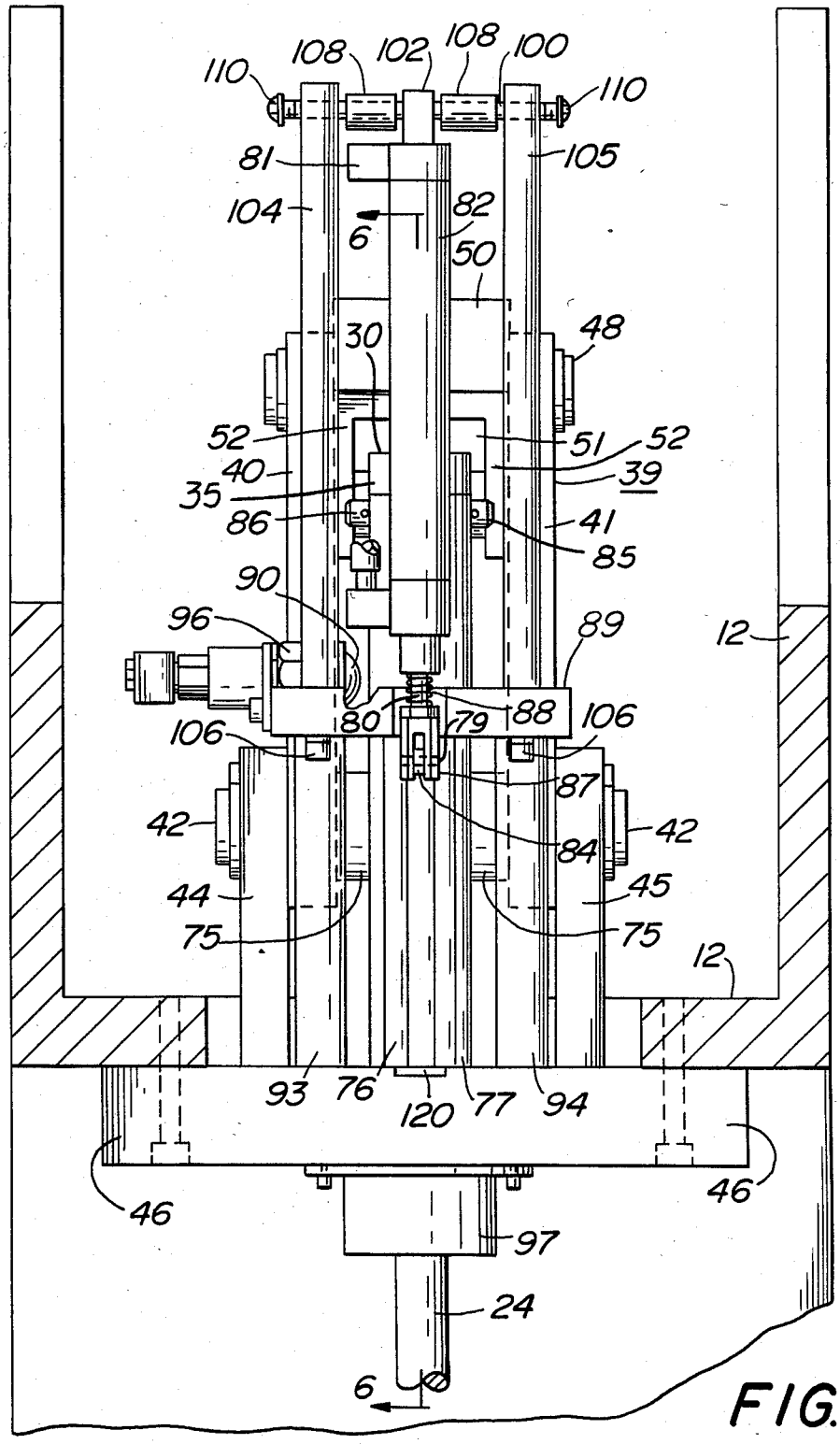
FIG. 4 is a front, partial view of the press taken along the line 4—4 in FIG. 2, but greatly enlarged relative thereto.
Figure 5:
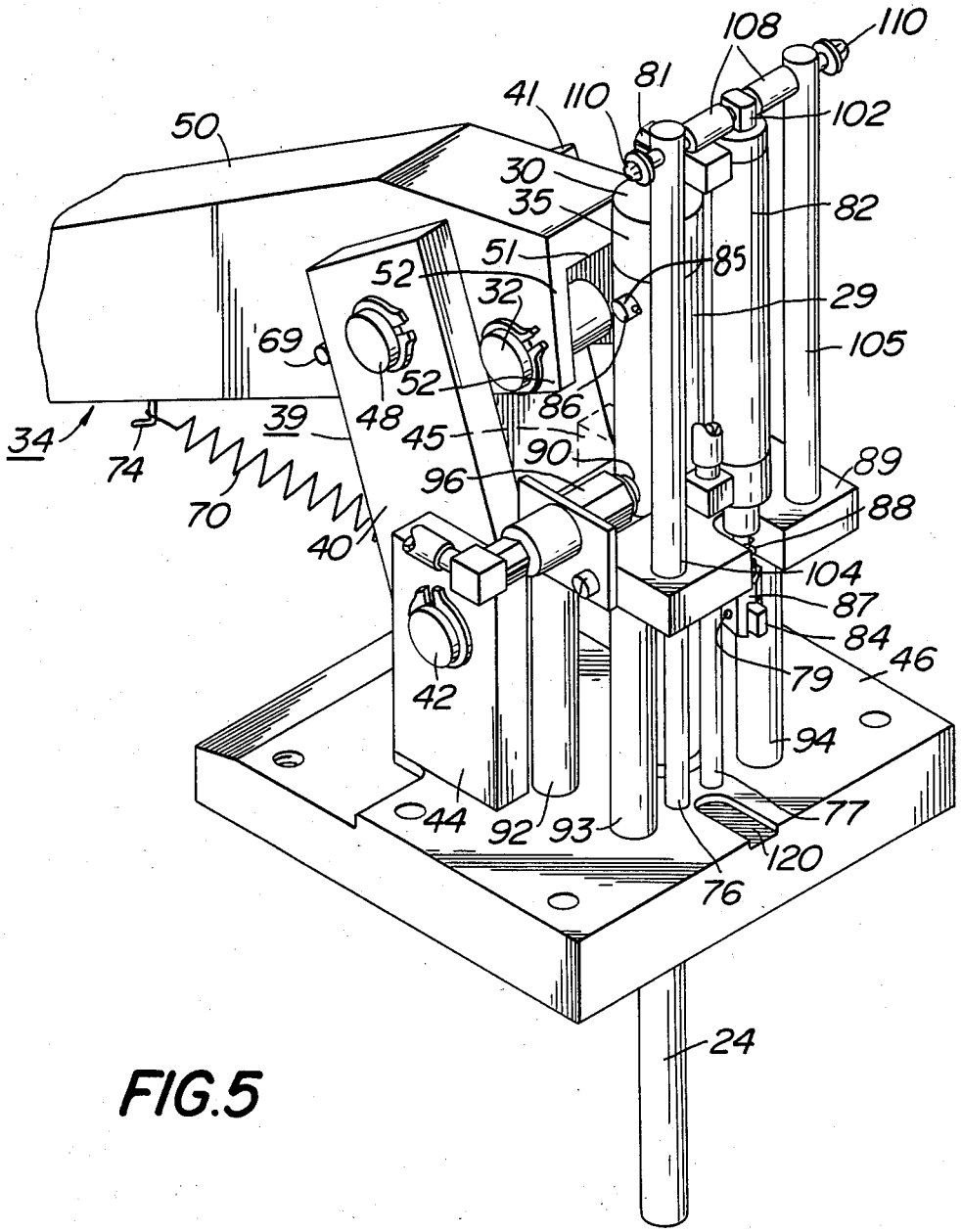
FIG. 5 is a front and top partial perspective view of the linkage mechanism, the ram assembly and associated parts shown in FIG. 4 and taken from the left side as viewed in FIG. 4.
Figure 7:
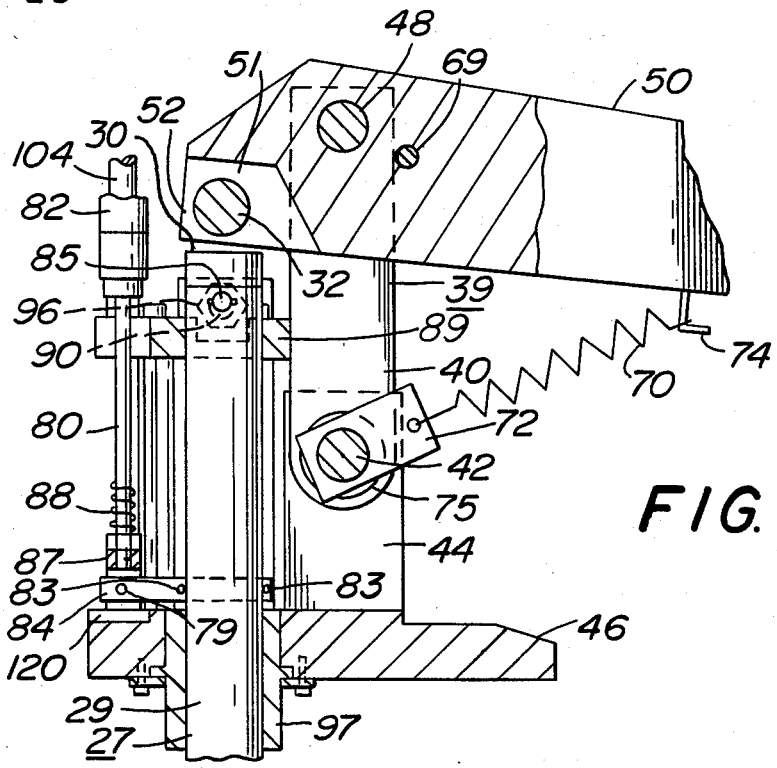
FIG. 7 is a view similar to FIG. 6, but showing an intermediate position of the linkage mechanism and ram assembly.
Figure 8:
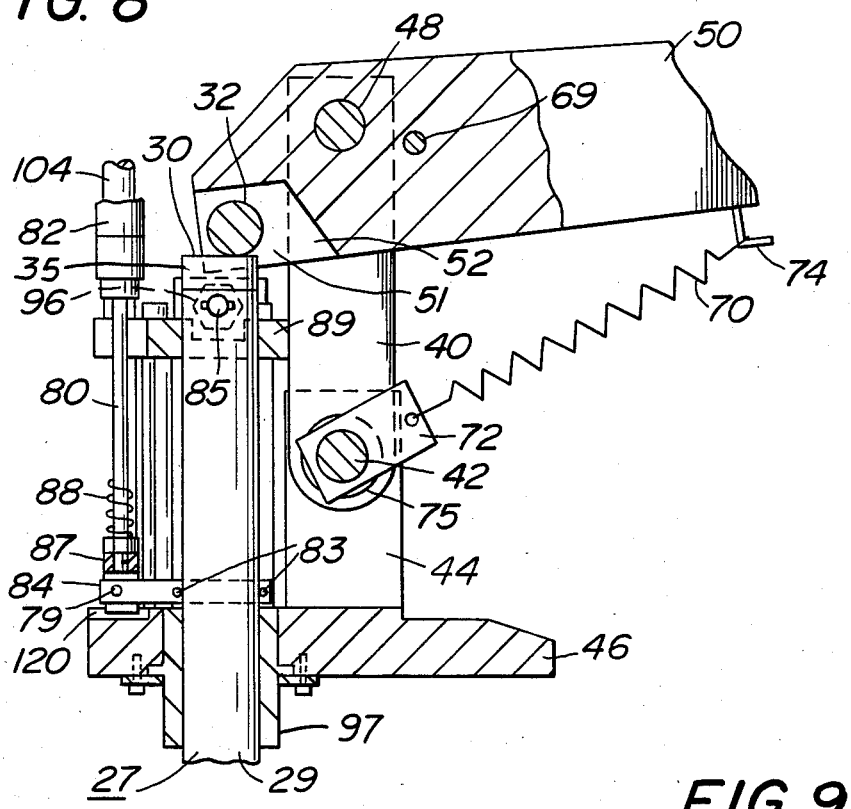
FIG. 8 is a view similar to FIG. 7, but showing the position of the linkage mechanism and ram assembly corresponding to the position of FIG. 3.

To so secure the fastener 31 in the plate 33, a suitable force is applied to a top surface 30, FIGS. 5, 7 and 8, of the cap 35 carried by the ram 29 by a two link mechanism 34 and, specifically, by a pressure pin 32 carried by a lever 50 of the two link mechanism 34. The lever 50 is pivotally connected by an upper pin 48 to another link 39, the link 39 being formed by two spaced link members 40 and 41 and the lever 50 being received between the two spaced link members 40 and 41, as shown in FIG. 5. The two spaced link members 40 and 41 are pivoted at their lower ends by a lower pin 42 to two stationary blocks 44 and 45 which are suitably secured to a bottom mount 46. The bottom mount 46 is, in turn, suitably secured to a horizontal portion of the frame 12 by bolts 47 as shown in FIG. 4.

As illustrated in the various views, the link 39 is short relative to the much longer lever 50 and for ease of description the link 39 is referred to as the "short link 39" and the lever 50 as the "long lever 50".

The long lever 50 extends beyond its pivotal connection to the short link 39 and the long lever 50 carries the pressure pin 32 forward of the link 39 and intermediate the link members 40 and 41. The pressure pin 32 extends through a groove 51 formed at the forward end of the long lever 50, as shown in FIGS. 5, 6, 7 and 8, and is mounted on spaced opposed walls 52 forming part of the long lever 50 and defining the groove 51. The end of the long lever 50 opposite to the end which carries the pressure pin 32 is pivotally connected by a further pin 53 to a stem 54 carried by a generally vertically extending rod 56 extending from a piston (not shown) within a generally vertically extending pneumatic cylinder 58 which is supplied with suitably pressurized air to extend or retract the rod 56. The cylinder 58 is itself pivotally mounted at its lower end by a bracket 60 which is pivoted to a pin 62 carried by a foot 64 suitably fixed to the frame 12.

As shown, the opposite ends of the pins 32, 42, 48, 53 and 62 carry suitable retaining rings to secure the pins against longitudinal movement.

Figure 6:
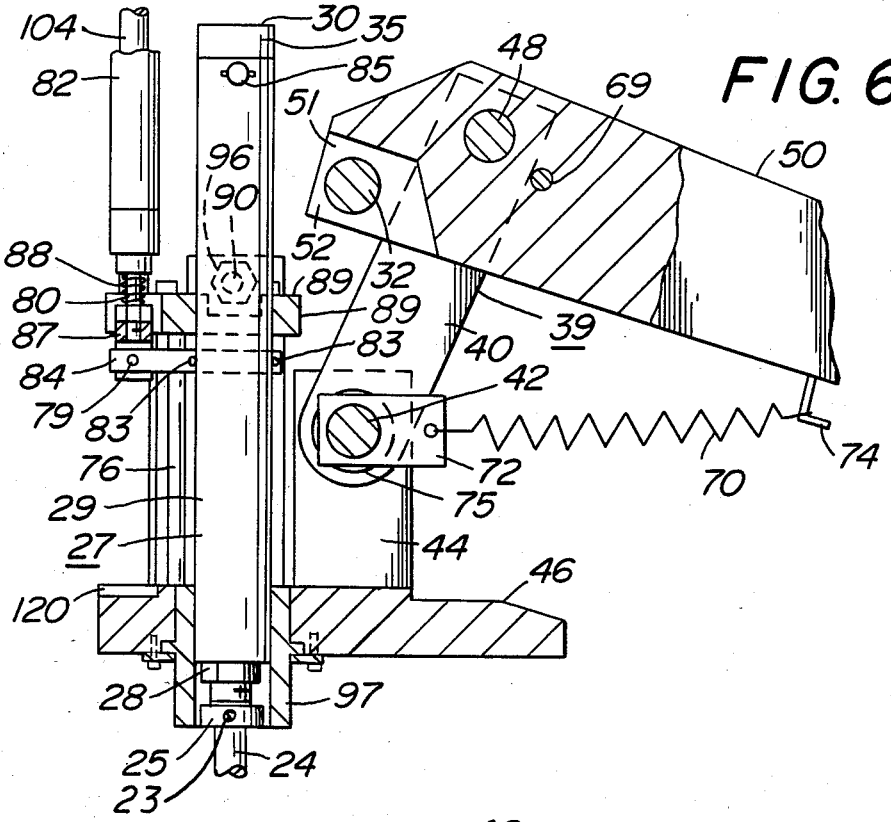
FIG. 6 is a partial side elevation of the linkage mechanism and ram assembly in the position shown in FIG. 2, but greatly enlarged relative thereto.

The short link 39 and the long lever 50 are biased toward each other by a tension coil spring 70 secured at the left end, FIGS. 6, 7 and 8, on a plate 72 and at the right end on a hook 74 depending from the lever 50. The movement of the short link 39 and the long lever 50 toward each other is limited by a pin 69 which is carried by the long lever 50 and extends through it with its end portions abutting the spaced members 40 and 41 in the positions of FIGS. 6 and 7. Thus, the lever is biased clockwise, as viewed in FIGS. 6, 7 and 8, so that the pin 32 is biased clockwise (toward the back) away from the top surface 30 of the ram 29 and to the rear of the ram 29, so as to not interfere with the ram 29 when the ram 29 is in its upper position. The plate 72 is pivotally mounted on the pin 42, as shown in FIGS. 6, 7 and 8, is spaced in the middle thereof by two spacers 75, FIG. 4.

Figure 2:
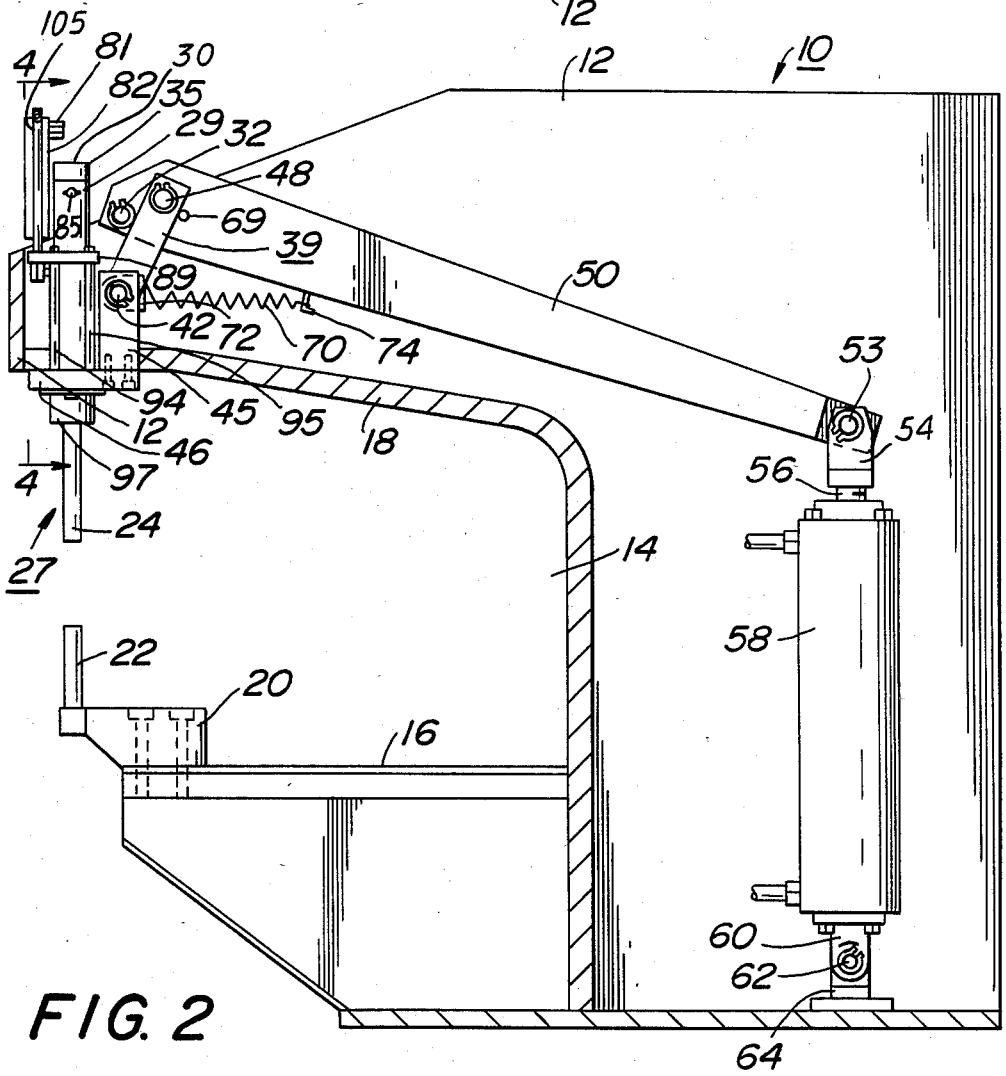
FIG. 2 is a side view similar to FIG. 1, but greatly enlarged relative to FIG. 1, and a portion of the frame has been cut away to show the internal construction, the ram assembly being shown in its upper position and the linkage mechanism fully retracted.

As shown in FIGS. 2, 5 and 6, the long lever 50 is pivoted clockwise to its fully retracted position, shown in FIGS. 2 and 6, when the rod 56 is fully retracted and at such time, the pin 32 and the ram assembly 27 are disjoined or disconnected from each other. At such time, there is no operative connection between the force which can be supplied from the pneumatic cylinder 58 and the ram assembly 27.

Movement of the ram 29 downwardly to a position where the cap 35 may thereafter be engaged by the pin 32 (when the latter moves forward and down toward the upper surface 30) is controlled by a rod 80 extending from a pneumatic cylinder 82, the rod 80 being connected to a portion of the ram 29 by an arm 84, extending through a suitable hole in the ram 29. The arm 84 extends horizontally as shown in FIGS. 6, 7 and 8 and is pivotally carried by a clevis 87 secured to the lower end of the rod 80 by a pin 79. Movement of the arm 84 relative to the ram 29 is restrained by two cross-pins 83, one on either side of the ram 29.

The upper end portion of the ram 29 carries a cross pin 85 which extends to the left, as shown in FIG. 4, beyond the ram 29, to form a nose 86. The rod 80 is connected to a piston (not shown) disposed within the cylinder 82 and during the steady state condition, i.e., immediately before a cycle starts, suitable pressurized air is admitted into the cylinder 82 to hold the piston in its raised or upper position so that the rod 80 is kept raised, as shown in FIGS. 2, 4, 5 and 6.

When a cycle of the press 10 is started, the supply of air to the cylinder 82 is terminated, and the air within the cylinder 82 is exhausted, causing the piston (not shown) within the cylinder 82, the rod 80 and the ram 29 to all gradually drop by gravity, but to assure the breakaway of the piston and the descent of the rod 80 a compression spring 88 may be placed around the rod 80 biased against the cylinder 82, as shown in FIGS. 4, 7 and 8. As the air is exhausted from the lower part of the cylinder 82 (below the piston, not shown) atmospheric air enters above the piston at the top of the cylinder 82 through a flow control valve 81. (If desired, slightly pressurized air could be supplied within the cylinder 82 so as to force the piston, not shown, down and further assure the descent of the rod 80.)

As best shown in FIGS. 2, 3, 4 and 5, four support rods or columns 92, 93, 94 and 95 are provided extending above the bottom mount 46. The columns 92, 93, 94 and 95 support a top mount or bearing plate 89. The columns are secured through the bottom of the bottom mount 46 and through the top of the bearing plate 89 by suitable screws or bolts. The wall of the bore through the plate 89 provides a bearing surface for the ram 29. The bottom mount 46 is provided with a bearing 97 to receive the ram 29. Thus, the plate 89 and the bearing 97 provide for guidance of the ram 29 as it moves up and down and a substantially rigid support for the ram 29.

To guide the ram 29 and restrain its rotation, the arm 84 is guided for reciprocal up and down movement by two vertical rods 76 and 77 suitably secured to the bottom mount 46 and the bearing plate 89.

Also, as shown in FIGS. 4 and 5, the cylinder 82 is supported by a horizontal pin 100 which extends through a block 102 carried by the cylinder 82. The end portions of the pin 100 are carried by two vertical columns 104 and 105, the columns 104 and 105 being secured to the bearing plate 89 by suitable bolts 106, shown in FIG. 4, extending through the bearing plate 89 from the bottom thereof. Two spacers 108, one on either side of the block 102 center the cylinder 82 and acorn nuts 110 are threaded to the opposite ends of the pin 100 to secure the pin 100 to the columns 104 and 105.

When the flow of pressurized air to the cylinder 82 is terminated and the air within it is exhausted, the rod 80 and the arm 84 will descend from the position of FIGS. 2 or 6 to the position of FIG. 7. When the nose 86 reaches the position of FIG. 7, it will depress a ball 90 of a ball valve 96 to permit pressurized air to flow into a pneumatic timer 168 and a four way pilot valve 170, FIG. 9, and thereafter the pressurized air will flow into the cylinder 58, thereby extending the rod 56 from the position shown in FIG. 2 to the position shown in FIG. 3.

When sufficient pressurized air flows within the cylinder 58, the rod 56 extends upwardly pivoting the long lever 50 counterclockwise about the lower pin 42 from the initial (fully retracted) position of FIGS. 2 and 6 to the intermediate position shown in FIG. 7. It is understood that before movement of the rod 56 starts, the ram assembly 27 has moved to its intermediate position shown in FIG. 7. In the position of FIG. 7 the ram 29 and the punch 24 have descended until the punch 24 rests against the fastener 31 to be installed in the plate 33 (the punch 24, fastener 31 and plate 33 not being shown in FIG. 7) and the only force being applied to the fastener is primarily that due to the weight of the ram assembly 27.

In the intermediate position shown in FIG. 7 the short link 39 has abutted a portion of the bearing plate 89 and further counterclockwise movement of the short link 39 is restrained and effectively stopped by the bearing plate 89. It will be seen that in the intermediate position of FIG. 7, the forward portion of the long lever 50 (which carries the pressure pin 32) now overlies the ram 29 and, in particular, now overlies the top surface 30 of the cap 35.

After the position shown in FIG. 7 is attained, continued upward movement of the rod 56 now further pivots the long lever 50 about the upper pin 48 (instead of the lower pin 42), since the short link 39 is now stopped by the bearing plate 89, causing the forward end of the long lever and the pressure pin 32 to rotate counterclockwise down toward the ram 29 until the pin 32 engages the upper surface 30 of the cap 35. Further continued movement upward of the rod 56 further pivots the long lever 50 about the upper pin 48 causing the pressure pin 32 to forcefully push against the upper surface 30 during which time the pressure pin 32 will rotate and roll in the wall 52. Depending upon the location of the pins 32 and 48 relative to the upper surface 30, the pin 32 may during further movement roll first slightly to the left, as viewed in FIGS. 7 and 8, before rolling to the right to the position shown in FIG. 8.

It should be noted that in movement of the long lever 50 from the position shown (partially) in FIG. 7 to the position shown (partially) in FIG. 8, the pin 69 moves away from its abutment with the link members 40 and 41 to the spaced apart positions shown in FIG. 8.

Also, in the movement from the position of FIG. 7 to that of FIG. 8, the lowest part of the clevis 87 moves into the clearance notch 120.

The partial view shown in FIG. 8 illustrates the maximum travel of the ram assembly 27 and of the long lever 50. At such time the fastener 31 has been pressed into the plate 33 the required amount. Thereafter, the rod 56 is retracted by the cylinder 58 and the two link mechanism 34 returns to the position of FIG. 6 and subsequent thereto the cylinder 82 is pressurized to retract the rod 80 and return the ram 29 and the punch 24 to the initial position, the position shown in FIGS. 1, 2, 4, 5 and 6. When the cylinder 82 is so pressurized, the piston (within the cylinder 82) will compress the atmospheric air within the cylinder 82 above the piston and the flow control valve 81 will provide a metered exhaust of the compressed air above the piston deaccelerating the upward movement of the piston, minimizing the impacting of the piston at the upper end of the cylinder 82.

Figure 9:
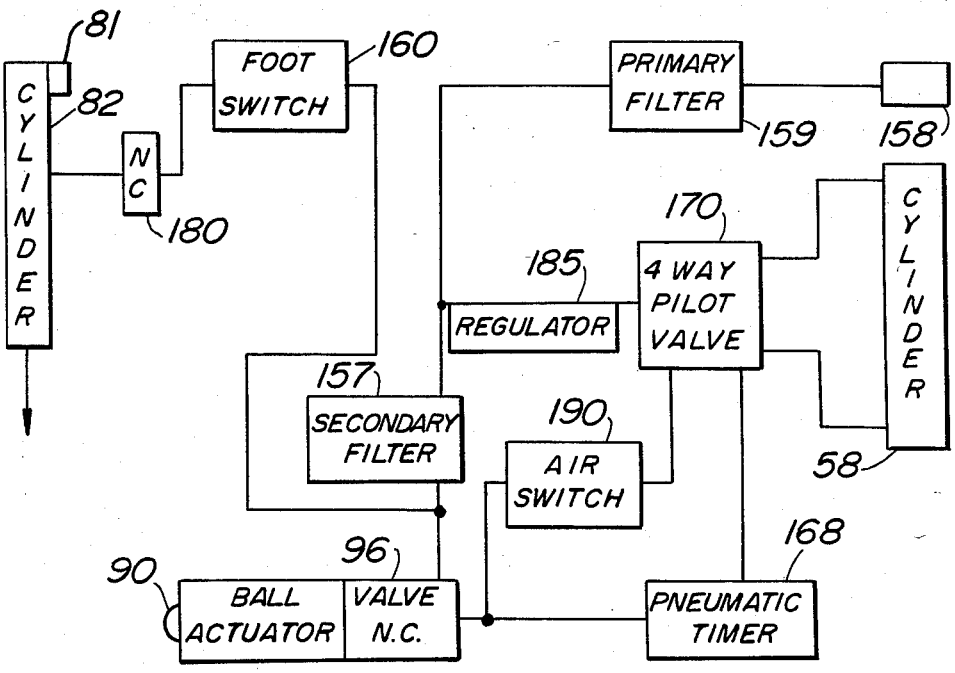
FIG. 9 is a diagrammatic view of the pneumatic circuit of the press.

FIG. 9 illustrates diagrammatically the pneumatic circuit for controlling the press 10, the circuit being connected to a suitable source 158 of pressurized air and a suitable primary filter 159 therefor. The pneumatic circuit includes the foot operated switch valve 160 which is depressed by the operator when it is desired to start a cycle. The foot switch valve 160 is normally open so that when the foot switch valve 160 is depressed it closes, terminating the flow of pressurized air to the cylinder 82 and simultaneously exhausting the pressurized air within the cylinder 82 out through a suitable port of the foot switch valve 160.

Since no air is then supplied to the cylinder 82 and the air already within it is thus exhausted, the piston within the cylinder 82 starts to descend by gravity (and the assist of spring 88) and because of the connection between the ram 29 and the rod 80 by virtue of the arm 84, the ram assembly 27 descends by gravity.

When the ram 29 descends sufficiently, the nose 86 will engage and depress the ball 90 of the ball valve 96, opening the latter. When the ball valve 96 is so opened, it permits pressurized air to flow into the pneumatic timer 168.

Prior to the initiation of the cycle by depressing the foot switch 160, it is seen by reference to FIG. 9 that pressurized air is supplied through a regulator 185 and the four-way valve 170 to the cylinder 58. At such time, pressure is supplied to the piston within the cylinder 58 to keep the piston retracted, i.e., at its bottommost position, as viewed in FIG. 2 so that the rod 56 is moved to its bottommost position, raising the left hand end of the long lever 50 about the pin 48 to its highest position.

Figure 3:
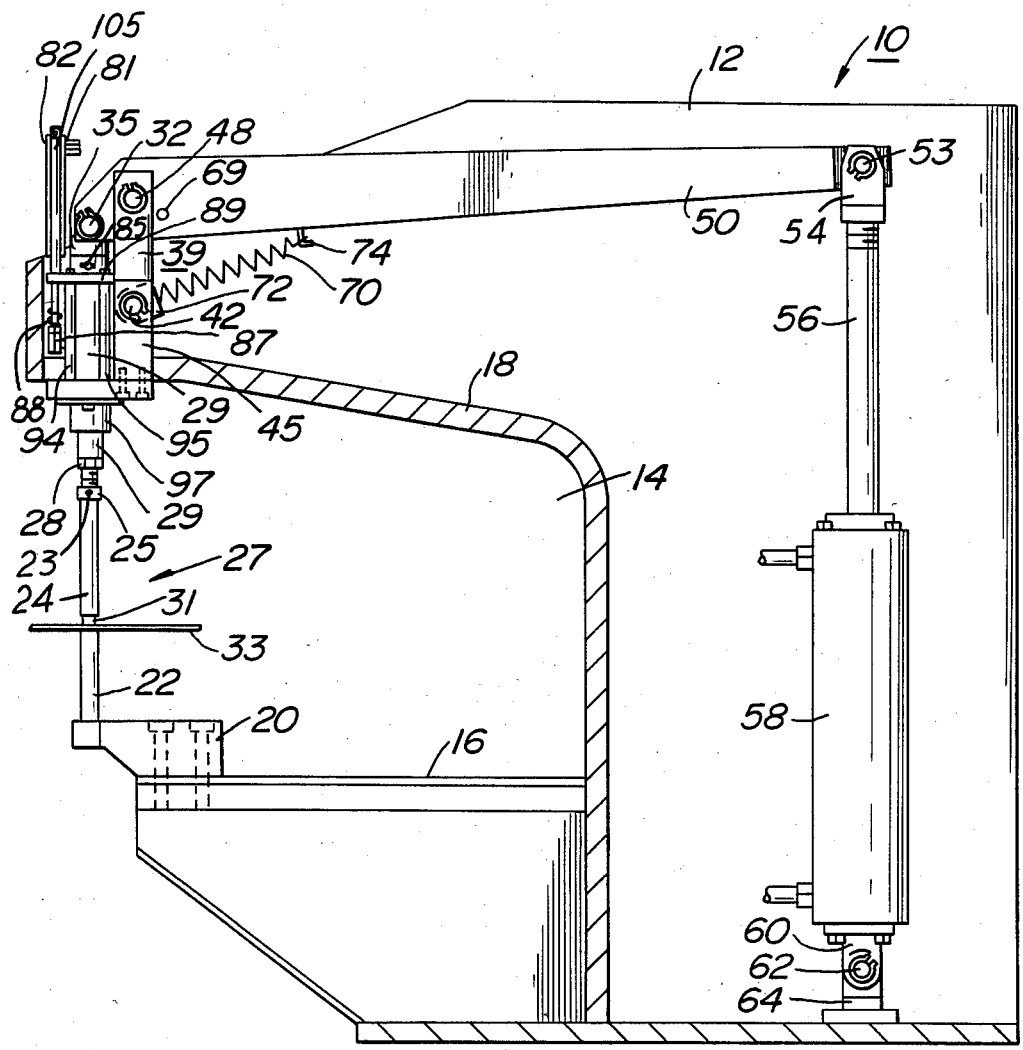
FIG. 3 is a side view similar to FIG. 2, but the ram assembly is fully lowered or extended, showing the fastener fully pressed into the sheeted material.

The pneumatic timer 168 signals the four-way valve 170 to simultaneously exhaust the pressurized air from the upper end of the cylinder 58 and to supply suitably pressurized air to the lower end of the cylinder 58, as viewed in FIGS. 2 and 3, causing the rod 56, stem 54 and pin 53 all to move up and thereby pivot the long lever 50 counterclockwise.

Such movement of the rod 56 together with the descent of the ram 29 will place the pin 32 and the ram 29 in a position where the pin 32 will press forcefully upon the cap 35 of the ram 29, to thereby exert the force required on the punch holder 25 and punch 24 to squeeze the fastener 31 into the plate 33. It will be noted that at such time the long lever 50 is effectively operatively connected or joined to the ram 29 and the punch holder 25.

The pneumatic timer 168 is adjustable so that the time period that pressurized air is supplied to the lower end of the cylinder 58 for the purpose of raising the right hand end of the long lever 50 may be varied as desired to assure a sufficiently long period of time during which the squeezing force is applied between the punch 24 and the anvil 22. However, the amount of force which is exerted downwardly by the long lever 50 is determined by the air pressure setting of the air regulator 185.

At the end of the predetermined time period the timer 168 signals the four-way valve 170 to reverse the flow of pressurized air to the cylinder 58 at which time the air is exhausted from the lower end of the cylinder 58 and pressurized air is supplied to the upper end of the cylinder 58, whereby the rod 56 is caused to move to down, lifting the pin 32 from the upper surface 30 to disjoin the long lever 50 from the ram 29 and punch holder 25.

Referring to FIG. 9, when the press 10 is ready to begin a cycle, it is seen that pressurized air from the suitable source 158 flows through the filter 159 and to the foot switch valve 160, to the cylinder 82 to raise the rod 80. The line pressure from the source 158 may be, for example, between 80 to 125 psi.

Pressurized air from the source 158 is also supplied, as shown in FIG. 9, to the pressure regulator 185 which reduces the air pressure to desired levels and through a secondary filter 157 also the the ball valve 96. The pressurized air from the regulator 185 flows into and through the four-way valve 170 to the cylinder 58. The operation of the four-way valve 170 is timed by the pneumatic timer 168 which receives pressurized air through the ball valve 96. Thus, by varying the pressure of the air at the regulator 185, the force developed at the rod 56 is varied accordingly and the duration of time of the force is controlled by the timer 168.

When it is desired to set up the press 10 for proper operation, it is necessary to maintain the rod 56 fully extended, the positions shown in FIG. 3 and 8. For this purpose a manually operable air switch 190 is provided, as shown in FIG. 9, between the ball valve 96 and the four-way pilot valve 170 to by-pass the pneumatic timer 168. With the ball actuator 90 depressed by the nose 86, thus opening the ball valve 96, the air switch 190 is manually opened and pressurized air is then supplied through the air switch 190 to the four-way valve 170 and to the cylinder 58, FIG. 9, whereby the rod 56 is extended. It is understood, however, that pressurized air is supplied to the cylinder 58, because of the opening of the air switch 190 after actuation of the ball 90 of the valve 96 by the nose 86.

If the descent of the ram assembly 27 is interrupted by an obstruction between the punch 24 and the fastener 31, FIG. 3, such as a hand or a finger, the nose 86 is kept from descending sufficiently to actuate the ball 90 of the valve 96 for the purpose of energizing the cylinder 58 and through the longer lever 50 exerting a sufficient force on the ram 29, punch holder 25 and punch 24 for the purpose of installing the fastener 31 into the plate 33. Thus, a safety feature has been incorporated into the press at the point of operation, i.e., at the punch 24.

In one embodiment the distance between the point at which the nose 86 first engages the ball 90 and activates the valve 96 and the point where the clevis 87 comes to rest against the bottom mount 46 is about 5/16 of an inch. The punch 24 and anvil 22 are adjusted accordingly so that the leading edge of the punch 24 will be about 5/16 of an inch from the sheeted plate 33, when the nose 86 first engages the ball 90. It is seen that 5/16 of an inch is less than the thickness of an adult hand or finger so that, if a hand or finger is interposed between the punch 24 and the fastener 31, the ball 90 will not be actuated and the power stroke of the press will not be started so that the risk of injury is minimal. During this 5/16 of an inch movement the nose 86 remains in contact with the ball 90 to keep the valve 96 actuated, that is, opened, so that pressurized air is supplied at such time to the cylinder 82.

While 5/16 of an inch has been given as an example of the distance between the actuation of the ball 90 and the final travel of the ram assembly 27, it will be understood that this distance may be increased or decreased, as may be required.

The rod 56 exerts a force upon the pin 53 to pivot the long lever 50 and this force is transferred to the ram 29 by the pin 32 seated on the upper surface 30 of the ram 29 to provide the power stroke or high force at the punch 24 necessary to install the fastener 31 to the plate 33. The duration of time of this force or power stroke is controlled by the timer 168 and the operator has no control over the duration of the power stroke so that the operator cannot reduce the quality of the work performed by the press by actuating the foot switch 160 after the power stroke has begun. At any time before the initiation of the power stroke, the actuation of the foot switch 160 will abort the cycle without injury to the two link mechanism 34. The abortion of the cycle is accomplished by removing one's foot from the foot switch valve 160 which opens the foot switch valve 160 providing pressurized air through valve 180 to the cylinder 82 to raise the ram 29.

It is seen by comparing FIGS. 6, 7 and 8 that the ram assembly 27 travels through a substantial distance, in one embodiment about 3 inches, essentially under the force of gravity.

After the pin 32 initially seats itself on the upper surface 30 of the ram 29, the nose 86 rides along the ball 90 for a distance of about 5/16 of an inch to assure that the valve 96 is kept open at such time but this distance may be adjusted by varying the shape of the nose 86, as required.

After the punch 24 contacts the fastener 31 and the punch 24 continues its downward movement due to the fact that the pin 32 rolls along the upper surface 30 as it presses on the cap 35 while the long lever 50 pivots. At such time the punch 24 exerts its maximum force upon the fastener 31, but it is understood that this maximum force is exerted and required for about 0.030 to 0.050 of an inch, the approximate distances that various fasteners are embedded into the sheeted plate 33.

From the foregoing it is also seen that the disclosed linkage mechanism can be viewed as a four-bar linkage in which the short link 39, the long lever 50, and the rod 56-cylinder 58 are the three movable links and the frame 12 is the fourth link.

While this invention has been described as incorporating pneumatic cylinder and pistons it will be understood that other types of pneumatic devices, such as bellows, could be used instead, and that other fluids or liquids could be used to operate the devices.

Also, while the nose 86 has been shown as formed by cross pin 85, it is seen that the upper portion of the ram 29 could be provided with an enlarged annular collar to replace the pin 85 so that even if the ram 29 were to rotate the engagement with the ball 90 of the valve 96 will still take place upon sufficient descent of the ram 29.

Also, while the pressure pin 32 has been shown as a separate piece carried by the long lever 50, it is seen that the end portion of the lever 50 could be appropriately shaped to provide a surface for engaging the upper surface 30 of the cap 35 carried by the ram 29.

In one embodiment, the required force of about six tons has been developed at the punch 24 by the use of a lever ratio of about 18 to 1. That is, the lever distance between the fulcrum pin 48 and the pin 53 is about 18 times greater than the lever distance between the pressure pin 32 and the fulcrum pin 48. Thus, the force applied by the cylinder 58 at the pin 53 is greatly multiplied by the lever 50 and applied at the pressure pin 32 to the ram assembly 27.

Referring to FIGS. 10, 11, 12 and 13 additional embodiments of this invention are illustrated diagrammatically. FIGS. 10 to 13, inclusive, show positions which correspond to the position shown in FIG. 7 for the first embodiment, that is, the ram assembly has descended to its intermediate position where it just engages the fastener and the pressure pin has moved over the ram assembly preparatory to engaging the ram assembly to apply a force sufficient to install the fastener in the plate.

Figure 10:
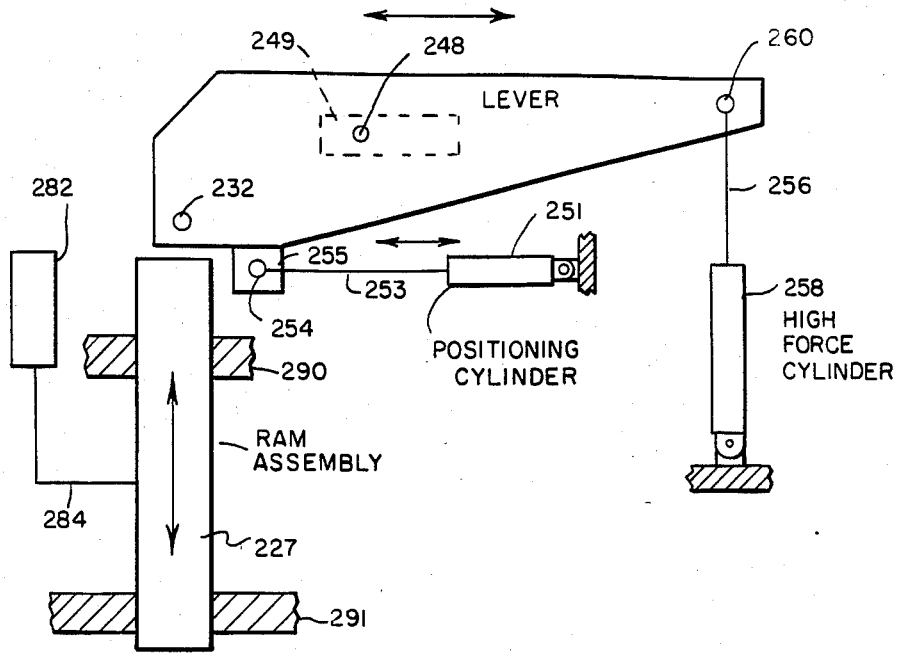
FIGS. 10, 11, 12 and 13 are diagrammatic views of four additional embodiments of this invention, these views illustrating positions corresponding to the intermediate position of the linkage mechanism and ram assembly, similar to the intermediate position shown in FIG. 7 for the first embodiment.

As seen in FIG. 10, a long lever 250 is movable horizontally back and forth toward and away from a ram assembly 227. The long lever 250 carries a fulcrum pin 248, the fulcrum pin 248 being slidable back and forth in a horizontal slot 249 formed in the frame (not shown). To move the lever 250 back and forth, a positioning cylinder 251 is provided from which extends a rod 253 which is pivotally secured to a pin 254 which is in turn secured to a bracket 255 carried by the lever 250. The rightmost end of the cylinder 251 is pivotally secured to the frame (not shown).

Further, the lever 250 carries a pressure pin 232 at its forward end, to the left of the fulcrum pin 248. The lever 250 is moved to the left, the position shown in FIG. 10, by the positioning cylinder 251 whereby the pressure pin 232 is moved to a position over the ram assembly 227 after the ram assembly 227 has descended to the position shown in FIG. 10.

At the rear end of the lever 250, to the right of the fulcrum pin 248, a pin 260 is pivotally connected to a rod 256 of a high pressure cylinder 258, FIG. 10. The lower end of the cylinder 258 is pivotally connected to the frame (not shown). After the lever 250 is moved to the left over the ram assembly 227 so that the pressure pin 232 is in position to engage the top of the ram assembly 227, extending the rod 256 will rotate the lever 250 counterclockwise, causing the pressure pin 232 to forcefully engage the ram assembly 227 and thereby insert the fastener (not shown) into the plate (not shown).

Thereafter, the rod 256 retracts, rotating the lever 250 back to its approximately horizontal initial position and the positioning cylinder 251 retracts its rod 253, causing the lever 250 to move horizontally back to its initial position.

As in the previous embodiment, a low pressure cylinder 282 with a rod 284 connected to the ram assembly 227 is provided to raise the ram assembly 227. The descent of the ram assembly 227 will actuate a valve (not shown) as in the previous embodiment to supply pressurized air to both the positioning cylinder 251 and the cylinder 258, it being understood that the positioning cylinder 251 must be actuated first and the lever 250 must be moved to the left first, before the high force cylinder 258, is actuated i.e., before the rod 256 is extended.

Suitable bearing providing supports 290 and 291 carried by the frame (not shown) are provided for the ram assembly 227.

Figure 11:
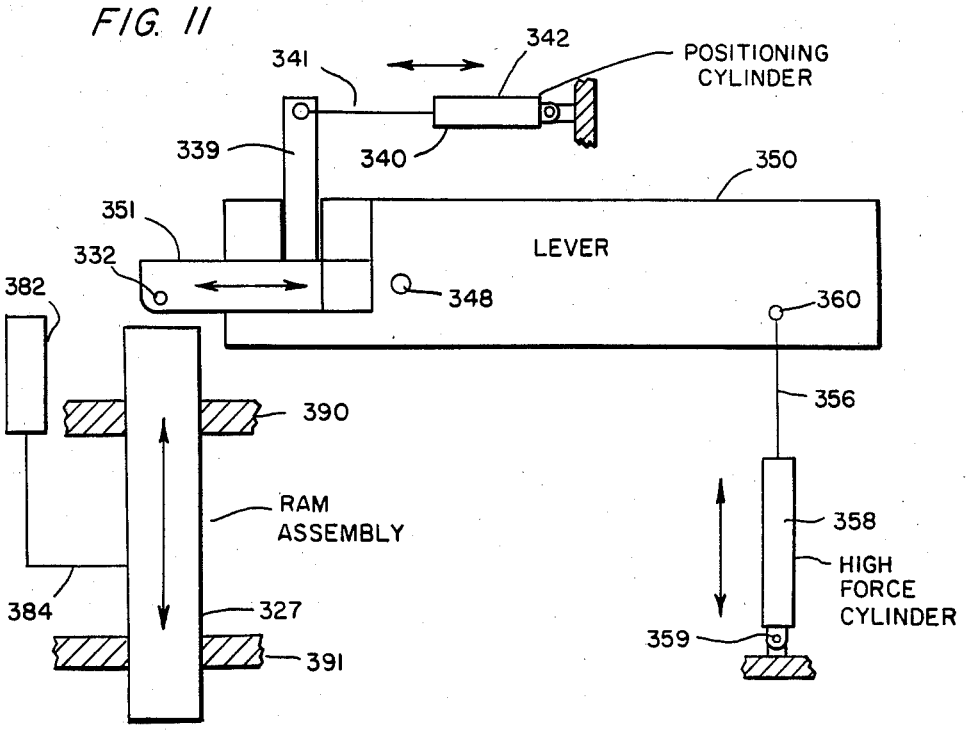

Referring to FIG. 11, a third embodiment is illustrated diagrammatically. As seen in FIG. 11 a long lever 350 carries a fulcrum pin 348, the ends of the fulcrum pin 348 being pivotally mounted on a frame (not shown).

The forward or left hand end of the lever 350 carries a telescoping bar 351 mounted in a suitable slot in the lever 350. Movement of the bar 351 back and forth is affected by a positioning cylinder 340 which has a rod 341 extending therefrom and connected to the arm 339 carried by the bar 351. The cylinder 340 is pivotally secured to the frame by a pin 342. Alternatively, the cylinder 340 may be carried and secured to the lever 350 (instead of the cylinder 340 being pivotally connected to the frame), but preferably the cylinder 340 would be pivotally connected to the lever 350 (and the rod 341 would be pivotally connected to the arm 339).

The telescoping bar 351 carries a pressure pin 332 over a ram assembly 327 when the ram assembly 327 has moved down so that when the lever 350 is rotated counterclockwise the pin 332 will engage the top portion of the ram assembly 327 to forcefully move the latter down.

The lever 350 is rotated back and forth by a high pressure cylinder 358 having a rod 356 pivotally connected to the right hand end of the lever 350 by a pin 360. The lower end of the cylinder 358 is pivotally connected to the frame (not shown) by a pin 359.

A suitable low pressure cylinder 382 (secured to the frame) having a rod 384 is connected to the ram assembly 327 for returning the ram assembly 327 to its initial position. Suitable bearing providing supports 390 and 391 carried by the frame (not shown) are provided for the ram assembly 327.

Figure 12:
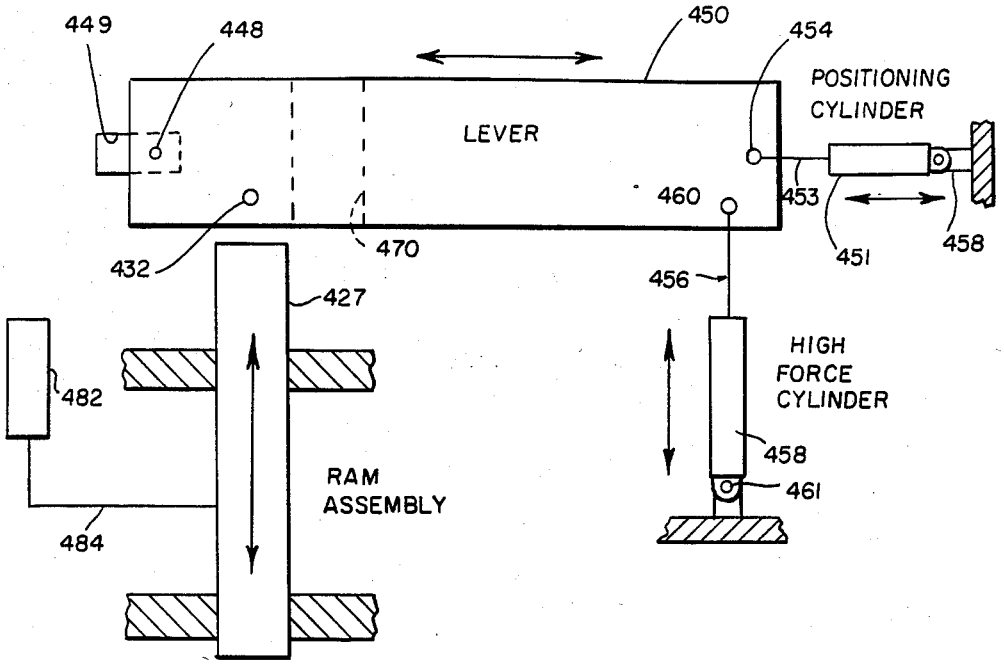

Referring to FIG. 12, a long lever 450 is movable horizontally back and forth toward and away from a ram assembly 427. The long lever 450 carries a fulcrum pin 448 at its extreme left hand portion, the fulcrum pin 448 being slidable back and forth in a horizontal slot 449 formed in the frame (not shown). To move the lever 450 back and forth, a positioning cylinder 451 is provided from which extends a rod 453 which is pivotally secured to a pin 454 carried by the right hand end of the lever 450. The rightmost end of the cylinder 451 is pivotally secured by a pin 459 to the frame (not shown).

Further, the lever 450 carries a pressure pin 432 to the right of the fulcrum pin 448, as shown. The lever 450 is moved to the right, the position shown in FIG. 12, by the positioning cylinder 451, whereby the pressure pin 432 is moved to a position over the ram assembly 427 after the ram assembly 427 has descended to the position shown in FIG. 12.

The long lever 450 has a large vertical hole 470 in it, as shown, to easily receive the upper portion of the ram assembly 427 when the ram assembly 427 is in its upper position (not shown in FIG. 12) and when the lever 450 has been moved to its leftmost position (not shown) by the positioning cylinder 451.

At the rear end of the lever 450, to the far right of the fulcrum pin 448, a pin 460 is pivotally connected to a rod 456 of a high pressure cylinder 458, FIG. 12. The lower end of the cylinder 458 is pivotally connected by a pin 461 to the frame (not shown). After the lever 450 is moved to the left so that the pressure pin 432 is in position to engage the top of the ram assembly 427, retracting the rod 456 will rotate the lever 450 clockwise, causing the pressure pin 432 to engage the ram assembly and thereby insert the fastener (not shown) into the plate (not shown).

Thereafter, the rod 456 extends, rotating the lever 450 back to its approximately horizontal initial position and the positioning cylinder 251 retracts its rod 253, causing the lever 450 to move horizontally back to its initial position.

The lever 450 will rotate down and up about the fulcrum pin 448 because of the pivotal connection provided by the pins 454, 459, 460 and 461.

As in the previous embodiment, a low pressure cylinder 482 with a rod 484 connected to the ram assembly 427 is provided to raise the ram assembly 427. The descent of the ram assembly 427 will actuate a valve (not shown) as in the previous embodiment to supply pressurized air to both the positioning cylinder 451 and the cylinder 458, it being understood that the positioning cylinder 451 must be actuated first and the lever 450 must be moved to the left first, before the high force cylinder 458, is actuated, i.e., before the rod 456 is extended.

Suitable bearing providing supports 490 and 491 carried by the frame (not shown) are provided for the ram assembly 427.

Figure 13:
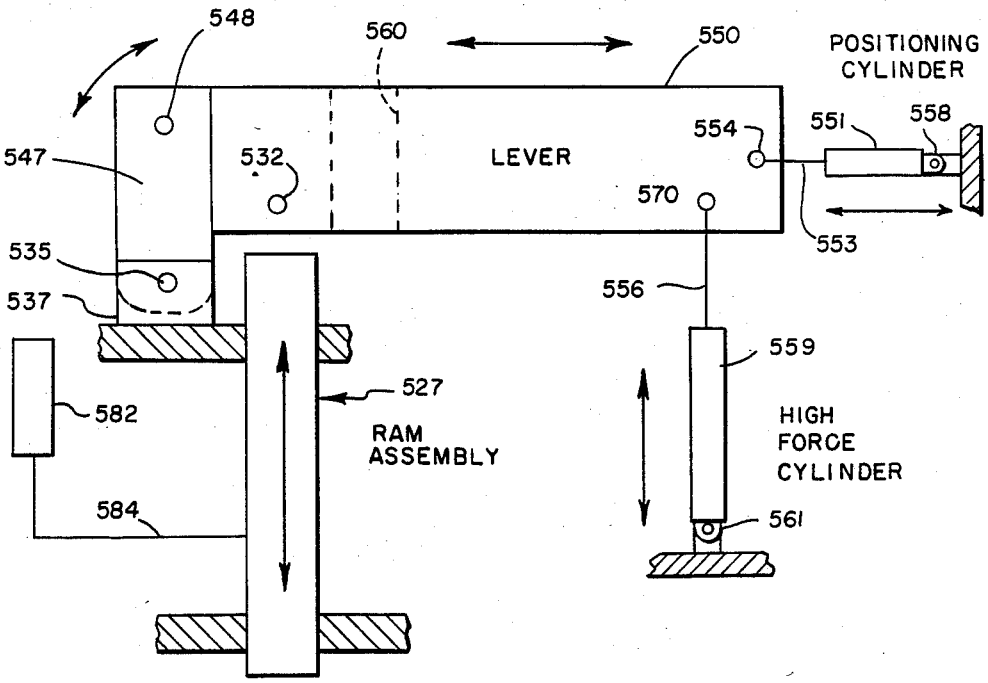

Referring to FIG. 13, a long lever 550 is pivotally movable back and forth toward and away from a ram assembly 527. The long lever 550 is pivotally fulcrumed on a pin 548 carried at its extreme left hand portion, the fulcrum pin 548 being carried by the upper end of a link 547, as shown. The lower end of the link 547 is pivoted about a further pin 535 which is carried by a bracket 537 secured to bearing support 590 which is together with another bearing support 591 secured to the frame (not shown). To pivot the lever 550 back and forth, a positioning cylinder 551 is provided from which extends a rod 553 which is pivotally secured to a pin 554 carried by the right hand end of the lever 550. The rightmost end of the cylinder 551 is pivotally secured by a pin 558 to the frame (not shown).

Further, the lever 550 carries a pressure pin 532 to the right of the fulcrum pin 548, as shown. The lever 550 is pivoted to the right, the position shown in FIG. 13, by the positioning cylinder 551, whereby the pressure pin 532 is moved to a position over the ram assembly 527 after the ram assembly 527 has descended to the position shown in FIG. 13.

The long lever 550 has a large vertical hole 560 in it, as shown, to easily receive the upper portion of the ram assembly 527 when the ram assembly 527 is in its upper position (not shown in FIG. 13) and when the lever 550 has been pivoted about the pins 535 and 548 to its leftmost position (not shown) by the positioning cylinder 551.

At the forward or left end of the lever 550, but to the right of the fulcrum pin 548, a pin 570 is pivotally connected to a rod 556 of a high pressure cylinder 559, FIG. 13. The lower end of the cylinder 559 is pivotally connected by a pin 561 to the frame (not shown). After the lever 550 is pivoted to the right so that the pressure pin 532 is in position to engage the top of the ram assembly 527, retracting the rod 556 will rotate the lever 550 clockwise, causing the pressure pin 532 to engage the ram assembly 527 and thereby insert the fastener (not shown) into the plate (not shown).

Thereafter, the rod 556 extends, rotating the lever 550 back to its approximately horizontal initial position and the positioning cylinder 551 extends its rod 553, causing the lever 550 to pivot back to its initial position (not shown) in which the upper part of the ram assembly 527 will extend into the hole 560.

The lever 550 will rotate down and up about the fulcrum pin 548 and the pin 535 because of the pivotal connection provided by the pins 554, 558, 570 and 561.

As in the previous embodiment, a low pressure cylinder 582 with a rod 584 connected to the ram assembly 527 is provided to raise the ram assembly 527. The descent of the ram assembly 527 will actuate a valve (not shown) as in the previous embodiment to supply pressurized air to both the positioning cylinder 551 and the high pressure cylinder 559, it being understood that the positioning cylinder 551 must be actuated first and the lever 550 must be moved to the left first, before the high force cylinder 559, is actuated, i.e., before the rod 556 is extended.

Referring to the embodiments shown in FIGS. 12 and 13, while large holes in the long levers have been shown to receive the upper portions of the ram assemblies, when the ram assemblies are in their upper positions (not shown), it will be understood that the long levers could be offset so as to provide suitable spaces for the upper portions of the ram assemblies.

From the foregoing it is seen that the embodiments of FIGS. 10 to 13, inclusive, also provide a long lever which is forcefully rotated by being connected at one end thereof to a high force cylinder. The long levers are all rotated about suitable fulcrums, as shown. The long levers all include portions which are engageable with a portion of the ram assemblies to forcefully drive the latter downwardly. The portions of the long levers which drive the ram assemblies down are movable into and out of operative engagement with the ram assemblies. The connections between the long levers and the high force cylinders are at a great distance from the fulcrums whereas the portions of the long levers which engage the ram assemblies are close to the fulcrums, whereby a very large lever advantage is achieved in the transfer of the force from the high force cylinders to the ram assemblies.

What I claim is:

1. A press for assembling a fastener or the like to a plate, or the like, comprising:

a frame, an anvil assembly carried by said frame, a ram assembly movable between upper, intermediate and lower positions, first actuating means for moving said ram assembly back and forth between said upper, intermediate and lower positions, a single lever having a first portion and a second pressure applying portion movable out of the path of movement of said ram assembly when said ram assembly is in its upper position and movable over said ram assembly when said ram assembly is in its intermediate position and in its lower position, an upper pin mounted on said single lever intermediate said first and second portions of said single lever for pivotally mounting said single lever to said frame and for providing a fulcrum for said single lever, second actuating means for moving said single lever out of the path of movement of said ram assembly when said ram assembly is in its upper position and for moving said single lever over said ram assembly and into force transmitting relation therewith when said ram assembly is in its intermediate position, causing said ram assembly for forcefully move to its lower position.

2. The combination of claim 1 and further described in that said single lever is pivotally connected to said second actuating means at the extreme end of said first portion of said single lever.

3. The combination of claim 2 further including a second lever pivotally connected to said frame at one end and connected by said upper pin to said single lever at its opposite end, means biasing said single lever and said second lever toward each other.

4. The combination of claims 1, 2, or 3 and further including said second actuating means includes a fluid means for actuating said single lever and applying a force to said ram assembly when said single lever is in force transmitting relation with said ram assembly, said first actuating means includes a first fluid cylinder and piston assembly for holding said ram assembly in its upper position, first fluid switch means for terminating the flow of fluid to said first fluid cylinder, thereby permitting said ram assembly to descend to its intermediate position, and second fluid switch means is activated after a sufficient descent of said ram assembly toward said lower position, whereby when said single lever is actuated said single lever is placed in force transmitting relation with said ram assembly with a force sufficiently high to insert said fastener into said plate and when said single lever is retracted out of force transmitting relation with said ram assembly, said ram assembly is permitted to descend and rise without contacting said single lever.

* * * * *